US005772091A

United States Patent [19]

Lackner

[11] Patent Number: 5,772,091

[45] Date of Patent: Jun. 30, 1998

[54] SUPPORT APPARATUS FOR A MUSICAL INSTRUMENT

[76] Inventor: Carl J. Lackner, 25005 Rainbow Dr., Olmsted Township, Cuyahoga County, Ohio 44138

[21] Appl. No.: 838,441

[22] Filed: Apr. 7, 1997

[51] Int. Cl.[6] ..... A45F 5/00; G10D 9/00

[52] U.S. Cl. ..... 224/265; 224/268; 224/910; 84/385 A

[58] Field of Search ..... 224/910, 265, 224/201, 266, 268; 84/385 A, 327, 453; 984/257

[56] References Cited

U.S. PATENT DOCUMENTS

| | | | |
|---|---|---|---|
| 385,473 | 7/1888 | Mulhollan . | |
| 2,015,869 | 10/1935 | Pulz . | |
| 2,356,209 | 8/1944 | Brilhart | 224/268 |
| 2,484,383 | 10/1949 | Lee . | |
| 2,643,803 | 6/1953 | Bates . | |
| 4,256,007 | 3/1981 | Streit . | |
| 4,453,442 | 6/1984 | LaFlame . | |
| 4,634,032 | 1/1987 | LaFlame . | |
| 4,802,613 | 2/1989 | Tierney . | |
| 4,895,286 | 1/1990 | DeRosa . | |
| 5,215,239 | 6/1993 | Walters, Jr. . | |
| 5,400,683 | 3/1995 | LaFlame . | |

FOREIGN PATENT DOCUMENTS

| | | |
|---|---|---|
| 0 492 028 A1 | 12/1990 | European Pat. Off. . |
| 667 935 A5 | 11/1985 | Switzerland . |

*Primary Examiner*—Linda J. Sholl
*Attorney, Agent, or Firm*—Fay, Sharpe, Beall, Fagan, Minnich & McKee

[57] ABSTRACT

A support apparatus (10) for supporting the weight of a musical instrument such as a saxophone (S) on the back and hips of a musician (M) is provided. A clip (12) engages a rear portion of a musician's belt (B) or pants (P). A pair of substantially rigid members (30*a*,30*b*) extend from the clip (12) and contact the musician's back (MB). The substantially rigid members (30*a*,30*b*) each include a curved portion (34*a*,34*b*), opposite the clip (12), that extends over and at least partially around the shoulders (S1,S2) of a musician (M). The distal end (36*a*,36*b*) of each member (30*a*,30*b*) lies adjacent a front portion (FP) of the musician (M). A strap assembly (50) is connected to the distal ends (36*a*,36*b*) of the substantially rigid members (30*a*,30*b*). A musical instrument clip (56) is connected to the strap assembly (50) and releasably attaches an instrument such as a saxophone (S) to the apparatus (10).

15 Claims, 3 Drawing Sheets

SUPPORT APPARATUS FOR A MUSICAL INSTRUMENT

BACKGROUND OF THE INVENTION

The present invention relates generally to a device that supports a musical instrument while the instrument is in use. It finds particular application in conjunction with saxophones of all varieties.

Saxophones are well known and in use around the world. One of the problems encountered by musicians who play the saxophone is the need to both support the weight of the instrument and play the instrument for extended periods of time. Saxophones, depending upon the variety, can weigh from five to ten pounds or more. Often a player will be required to support the instrument for several hours or more during practice or a performance. This leads to discomfort, pain, poor posture, fatigue, and loss of concentration on the part of the saxophone player.

Known saxophone support devices cause and/or aggravate these problems. Known devices are generally provided in the form of one or more straps that the musician wears about his or her neck and shoulders. These straps, even if padded, eventually cause discomfort due to the concentration of the saxophones weight on the neck and/or shoulders of the musician. Further, these devices can cause a musician to assume an unnatural posture during play and can impede natural head movement.

The lack of an effective apparatus for supporting a saxophone during the play thereof has decreased the popularity of the saxophone and other similar instruments. Further, some musicians have been forced to reduce the amount of practice and/or playing time to avoid neck and shoulder strain. Also, the above-noted problems are especially apparent for young and old players with less physical strength.

Accordingly, it is desirable to develop a new and improved support device for saxophones and other musical instruments which would overcome the foregoing deficiencies and others while meeting the above-stated needs and providing better and more advantageous overall results.

SUMMARY OF THE INVENTION

According to the present invention, a new and improved support apparatus for a musical instrument is provided.

In accordance with a first aspect of the present invention, a support apparatus for supporting the weight of a musical instrument at least substantially on the back and hips of a musician includes a clip for engaging a rear portion of a musician's belt. At least one substantially rigid member extends from the clip and contacts the musician's back. The substantially rigid member includes a curved portion, opposite the clip, that extends over and at least partially around the shoulder of a musician. The distal end of the at least one member lies adjacent a front portion of the musician. At least one flexible strap is connected to a distal end of the at least one substantially rigid member. A clip is connected to the at least one flexible strap and releasably attaches a saxophone or other instrument to the apparatus.

In accordance with another aspect of the present invention, a support apparatus includes means for engaging clothing of a musician adjacent a lower back region of the musician. At least one substantially rigid member extends from the clothing engagement means. The at least one member includes a first region proximate the clothing engagement means which lies generally adjacent the lower back region of the musician. The at least one member also includes a second region curved to conform generally to the contour of the musician's shoulders. The distal end of the at least one member is positioned adjacent a front region of the musician and below the musician's neck. Means for releasably attaching a musical instrument to the apparatus is also provided.

One advantage of the present invention is that it provides a new and improved musical instrument support apparatus.

Another advantage of the present invention is that it eliminates neck and shoulder strain and fatigue of a musician.

Still another advantage of the present invention is that it supports the weight of a musical instrument at least substantially on the back and the hips, rather than on the shoulders, of a musician.

Yet another advantage of the present invention is that it improves the posture of a musician and allows unimpeded head and neck movement.

A further advantage of the present invention is that it is adjustable to accommodate differently sized musicians, different instruments, and different playing positions.

A still further advantage of the present invention is that it allows a musician to more easily and effectively play the musical instrument supported thereby.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components. The drawings are only for purposes and illustrating a preferred embodiment and are not to be used to limit the invention.

DETAILED DESCRIPTION OF THE PREFERRED EMBODIMENT

Figure 5:
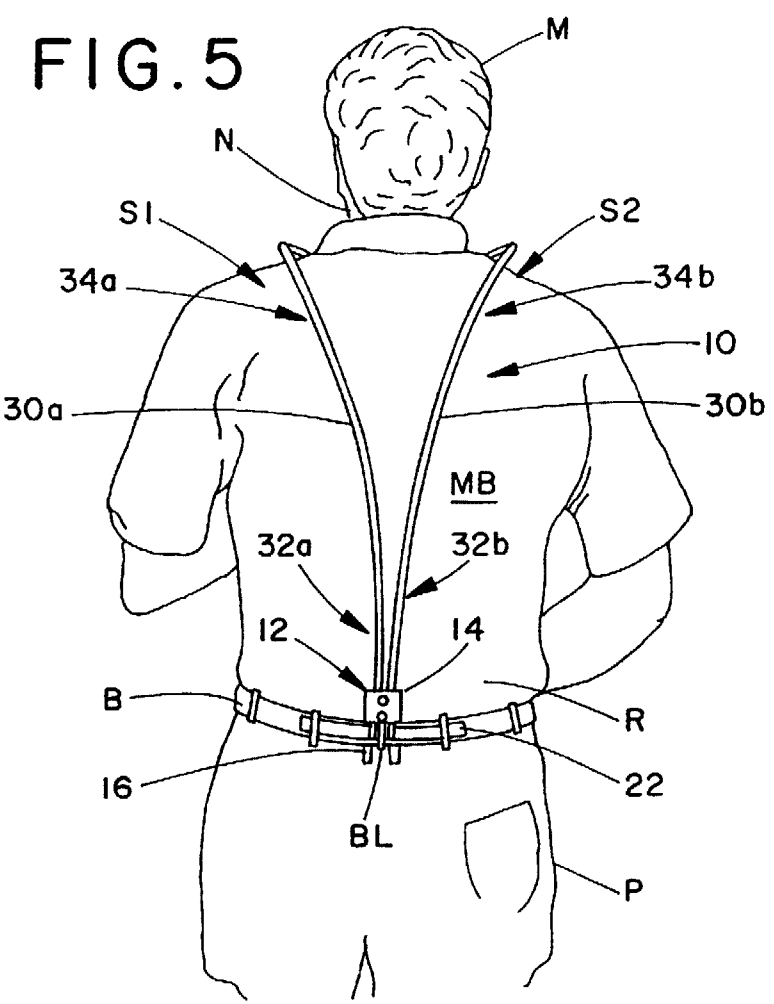
FIG. 5 is a rear elevational view of the apparatus shown in FIG. 1 as it is used by a musician to support a saxophone; and, FIG. 6 illustrates an alternative clothing clip in accordance with the support apparatus of the present invention.

Referring now to the FIGURES, a support apparatus for a musical instrument in accordance with the present invention is shown generally at 10. The apparatus 10 includes means for releasably engaging the clothing of a musician M adjacent a lower region R of the musician's back MB. Preferably a belt clip 12 is provided as the clothing engagement means and releasably engages a belt B worn about the waist and hips of the musician M. The belt clip 12 includes a body 14 having a tongue 16 depending therefrom. The tongue 16 passes between the belt B and the lower back region R of the musician M. Upon insertion of the tongue 16 as described, the belt B is engaged with the surfaces 18, 20 of the tongue 16 and the body 14, respectively. The clip 12 is thus restrained from further downward movement or outward movement away from the musician M. Alternatively, the clip 12 can be engaged with the waistband of the pants P worn by the musician M. Also, as is shown in FIG. 5, a rigid member, such as a metallic or plastic bar 22 can be utilized adjacent a portion of the belt B to stiffen the belt B and distribute the weight of the saxophone S or other instrument connected to the apparatus 10 across several belt loops of the pants P. The tongue 16 preferably includes a deep notch 19 formed therein to accommodate the middle or other belt loop BL of a pair of pants P.

At least one, and preferably first and second substantially rigid support members 30*a*,30*b* are connected to and extend upward from the clip 12. The support members 30*a*,30*b* are preferably made from a strong, light-weight, and selectively bendable material such as aluminum rods or the like. The support members 30*a*,30*b* are selectively bendable such that each can be adjusted to properly fit a particular musician M while still being sufficiently rigid to support the weight of a saxophone S or other instrument without more than minimal flexing.

Figure 4:
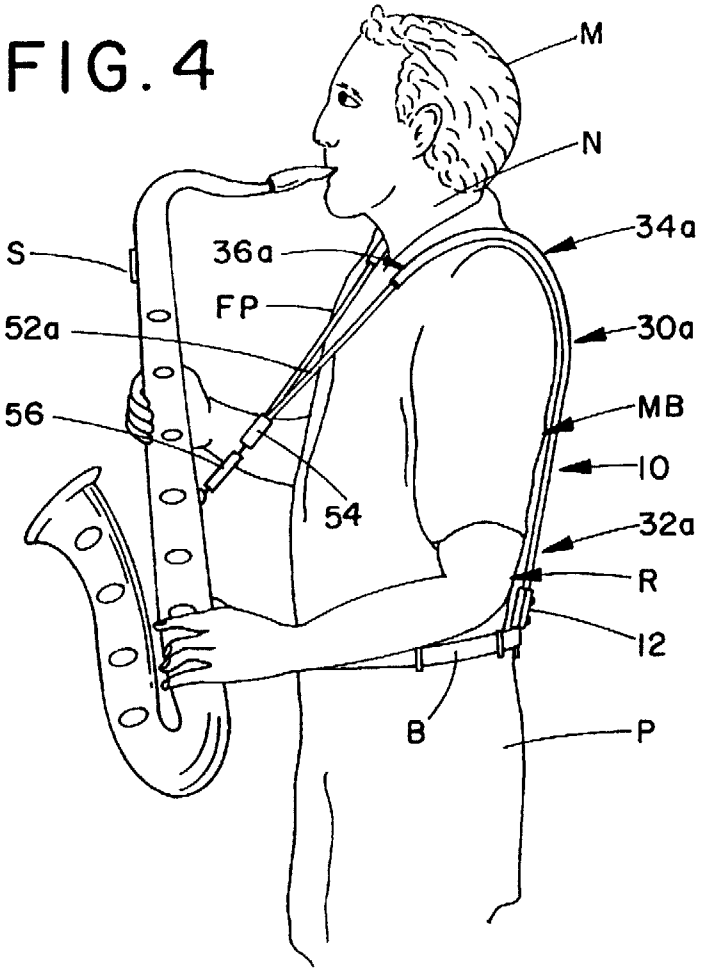
FIG. 4 is a side elevational view of the apparatus shown in FIG. 1 as it is used by a musician to support a saxophone.

Each member 30*a*,30*b* respectively includes a first, lower portion 32*a*,32*b* that is connected to the clip 12 and an upper curved portion 34*a*,34*b*, opposite the clip 12, which passes respectively over first and second shoulders S1,S2 of the musician M, preferably in a non-contacting relationship with the relevant shoulder S1,S2. The upper curved regions 34*a*,34*b* terminate at the distal ends 36*a*,36*b* of each member 30*a*,30*b*, respectively. The first, lower portions 32*a*,32*b* of each member 30*a*,30*b* extend upward from the clip 12 adjacent the musicians back MB. As is seen in FIGS. 4 and 5, the upper, curved regions 34*a*,34*b* of each member 30*a*,30*b* curve respectively over the shoulders S1,S2 of the musician M and generally follow the contour of the shoulders S1,S2 such that the distal end 36*a*,36*b* of each member is in front of the musician M, adjacent the collarbone, upper chest, or other front portion FP of the musician M, preferably in a non-contacting relationship with the front portion FP. The distal ends 36*a*,36*b* are thus preferably positioned beneath the elevation of the musician's neck N. The position of the ends 36*a*,36*b* beneath the elevation of the musician's neck N reduces neck strain, increases the freedom of movement of the musician's head and neck, and helps to position the saxophone S or other musical instrument in its natural playing position in front of the musician M. At least a portion of each member 30*a*,30*b* contacts the musician's back MB such that the musician's back MB supports at least a portion of the weight of the instrument such as the saxophone S.

With more particular reference to FIGS. 4 and 5, it can be seen that the lower regions 32*a*,32*b* of the support members 30*a*,30*b* are preferably generally parallel to each other and positioned closely together. In this manner, the lower regions 32*a*,32*b* lie generally adjacent the spine or central portion of the musician's back MB and such that the weight of the saxophone S or other instrument does not adversely affect the balance or movement of the musician M. The curved portions 34*a*,34*b* pass on opposite sides of the musicians neck N. Although the curved portions 34*a*,34*b* conform generally to the contour of the shoulders S1,S2, respectively, it is preferable that the curved portions 34*a*,34*b* do not physically contact the shoulders S1,S2 and that the distal ends 36*a*,36*b* do not contact the front portion FP of the musician M.

Thus, as is shown in FIG. 4, at least substantially all of the weight of the saxophone S or other instrument is borne on the hips of the musician M through the belt B and on the musician's back MB through the support members 30*a*,30*b*. The surface 18 of the tongue 16 exerts an outward force on the belt B, away from the lower region R of the musicians back MB. The surface 20 of the clip body 14 prevents downward movement of the clip body 14 relative to the musicians belt B. The space between the shoulders S1,S2 and the curved portion 34*a*,34*b* of each member 30*a*,30*b* allows each curved region 34*a*,34*b* to flex slightly toward and away from the shoulders S1,S2 of the musician M for increased comfort and shock absorption while playing the saxophone S or other instrument.

Figure 1:
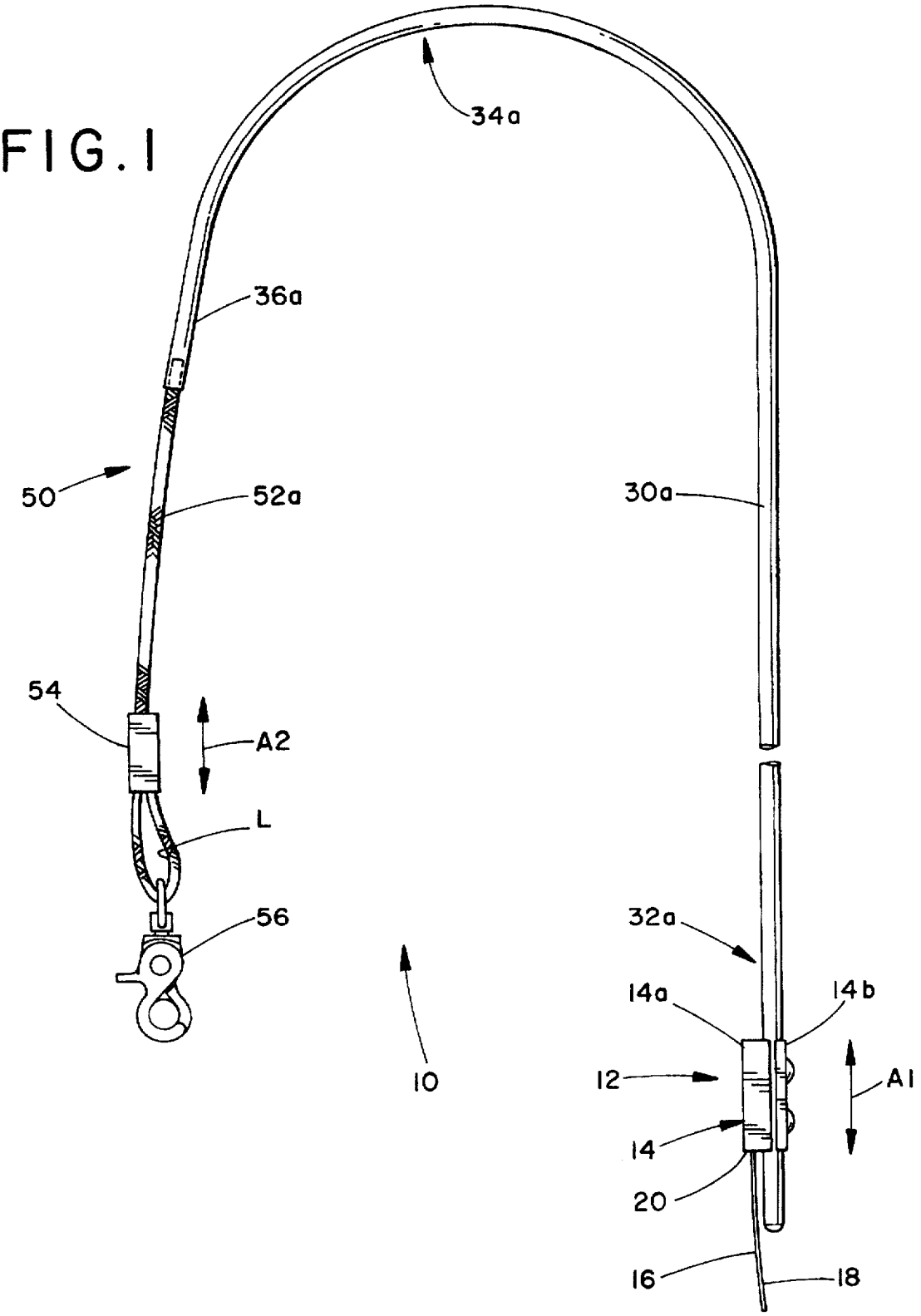
FIG. 1 is a side elevational view of a support apparatus for a musical instrument in accordance with the present invention.
Figure 3:
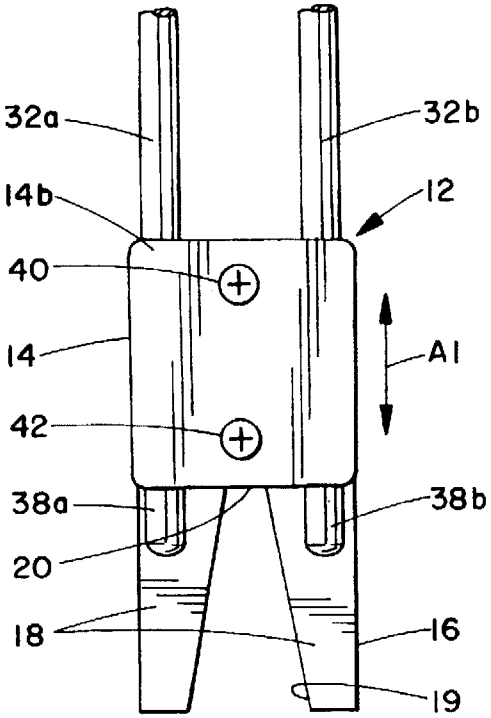
FIG. 3 is an enlarged, rear elevational view of a clothing clip in accordance with the musical instrument support apparatus of the present invention.

Referring now particularly to FIGS. 1 and 3, the connection of the support members 30*a*,30*b* to the clip 12 is shown in further detail. The body 14 of the clip 12 includes a first half 14*a* and a second half 14*b*. The lower portion 32*a*,32*b* of each member 30*a*,30*b* passes between the first and second halves 14*a*,14*b*. Screws 40, 42 or the like secure the halves 14*a*,14*b* together and, when tightened, releasably retain the members 30*a*,30*b* therebetween. The proximal end 38*a*,38*b* of each member 30*a*,30*b* preferably extends from the clip 12. These proximal ends 38*a*,38*b* facilitate the releasable engagement of the clip 12 with the belt B of the musician M. Therefore, when the screws 40,42 are loosened, the position of the clip 12 relative to the members 30*a*,30*b* can be varied as indicated by the arrow A1, depending upon the size of the musician M, to lengthen and shorten the members 30*a*,30*b*. The proximal ends 38*a*,38*b* of the members 30*a*,30*b* can be trimmed accordingly once the apparatus 10 is fitted to a particular musician M. The adjustability of the clip 12 relative to the members 30*a*,30*b*, and the ability to selectively bend the support members 30*a*,30*b* to conform to the back MB and shoulders S1,S2 of the musician M allows the apparatus 10 to be customized to fit a wide variety of musicians.

Figure 2:
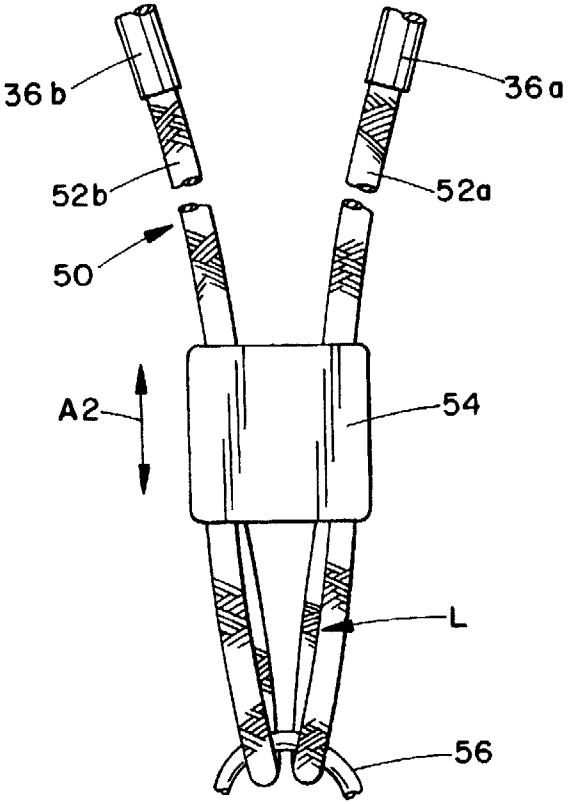
FIG. 2 is an enlarged, front elevational view of an adjustable cord lock in accordance with the support apparatus of the present invention.

The apparatus 10 also includes means for selectively connecting a saxophone S or other instrument thereto. Preferably, a strap assembly 50 is utilized as the instrument connection means. With reference now to FIGS. 1 and 2, the strap assembly 50 includes first and second straps 52*a*,52*b* connected respectively at one end thereof to the distal ends 36*a*,36*b* with a fastener, adhesive or any other suitable fastening means. These straps 52*a*,52*b* are preferably resilient "bungee" cords or similar resilient cords for increased comfort and shock absorption. The strap assembly 50 is preferably adjustable in length. Therefore, an adjustable cord lock 54 is provided. The cords 52*a*,52*b* pass through the cord lock 54 and the free ends thereof are connected to the cord lock 54 such that a loop L is formed. The cord lock 54 frictionally engages the straps 52*a*,52*b* but is slidable along the straps 52*a*,52*b* as indicated by the arrow A2 to adjust the size of the loop L, and consequently the length of the strap assembly 50. A musical instrument attachment hook or clip 56 is connected to the loop L and releasably connects a musical instrument such as the saxophone S to the strap assembly 50. In this manner, different size saxophones, different size musicians, different types of instruments, and different playing positions can be accommodated by the apparatus 10.

Figure 6:
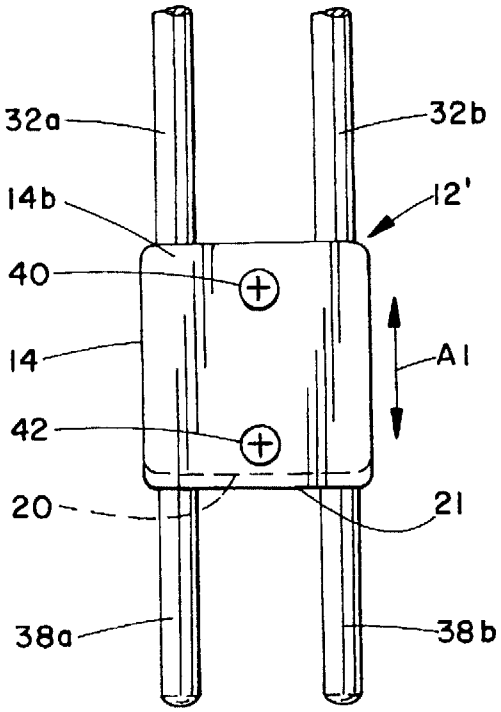

FIG. 6 illustrates an alternative clothing clip 12'. The clip 12' does not include a tongue. Instead, the proximal ends 38*a*,38*b* of the support members 30*a*,30*b* are extended and are inserted behind a belt B or into the waistband of the pants P in place of the tongue. The base 14 of the clip 12' includes a rear lip 21. The belt B or pants P of the musician M is retained against the surface 20 of the base 14, between the ends 38*a*,38*b* and the lip 21.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or equivalents thereof.

Having thus described the preferred embodiment, the invention is now claimed to be:

1. An apparatus for supporting the weight of a musical instrument at least substantially on the hips and back of a musician, said apparatus comprising:

a clip selectively engageable with a rear portion of a belt of a musician;

at least one substantially rigid member extending from said clip for engaging said back of said musician, said at least one substantially rigid member including a curved portion opposite said clip for extending over and at least partially around a shoulder of said musician in conformity therewith such that a distal end of said at least one substantially rigid member is positioned adjacent a front portion of said musician;

at least one strap connected to said distal end of said at least one substantially rigid member; and, a clip connected to the at least one strap for releasably connecting a musical instrument to said at least one strap.

2. An apparatus as set forth in claim 1, wherein said at least one substantially rigid member comprises first and second substantially rigid members extending from said clip and each including a curved portion opposite said clip extending over and at least partially around first and second shoulders of said musician in conformity therewith, each of said first and second members having a distal end located beneath the elevation of said neck of said musician.

3. An apparatus as set forth in claim 2, wherein said first and second members are selectively bendable to conform in shape to said back and said first and second shoulders of said musician, respectively.

4. An apparatus as set forth in claim 2, wherein said first and second members are made from aluminum rods.

5. An apparatus as set forth in claim 1, wherein said clip releasably engages said at least one substantially rigid member such that the position of said clip relative to said at least one substantially rigid member is adjustable to thereby adjust the length of said at least one substantially rigid member.

6. An apparatus as set forth in claim 1, wherein said clip includes a tongue depending therefrom for selective insertion between said belt and said back of said musician, said tongue including a notch for accommodating a belt loop of pants worn by said musician.

7. An apparatus as set forth in claim 2, wherein said at least one strap comprises first and second straps extending respectively from said first and second distal ends of said first and second substantially rigid members; and, said apparatus further comprises means for selectively adjusting the length of said first and second straps.

8. A musical instrument support apparatus comprising:

means for releasably engaging a musicians clothing adjacent a lower back region of said musician;

at least one substantially rigid member extending from said clothing engagement means, said at least one substantially rigid member including:

a first portion proximate said clothing engagement means and lying generally adjacent a central lower back region of said musician; and, a second portion curved to conform generally to the contour of a shoulder of said musician such that said second region extends over said shoulder of said musician in at least a substantially non-contacting relationship therewith and terminates at a distal end in front of said musician; and, means for releasably connecting a musical instrument to said at least one substantially rigid member.

9. An apparatus as set forth in claim 8, wherein said at least one substantially rigid member comprises first and second substantially rigid members extending from said clothing engagement means, said first and second members each including a first portion proximate said clothing engagement means lying generally adjacent a central, lower back region of said musician and a second curved portion conforming generally to the contour of first and second shoulders of said musician, respectively, said first and second members terminating respectively in first and second distal ends in front of and beneath the elevation of a neck of said musician.

10. An apparatus as set forth in claim 9, wherein said first and second substantially rigid members are selectively bendable to provide selective adjustment of the shape thereof.

11. An apparatus as set forth in claim 9, wherein said clothing engagement means is provided by a clip, and wherein said first and second substantially rigid members are slidably and releasably engaged with said clip for selective adjustment of the length of said first and second members extending from said clip.

12. An apparatus as set forth in claim 11, wherein said clip includes a first half and a second half, and wherein a portion of each of said first and second substantially rigid members is selectively engaged between said first and second halves of said clip.

13. An apparatus as set forth in claim 12, wherein said clip includes a body and a tongue depending from said body, said tongue selectively insertable between a belt of said musician and said lower back region of said musician.

14. An apparatus as set forth in claim 9, wherein said means for releasably connecting a musical instrument comprises an adjustable strap assembly connected to said first and second distal ends of said first and second substantially rigid members.

15. An apparatus as set forth in claim 14, wherein said adjustable strap assembly comprises:

first and second straps respectively attached at one end to said first and second distal ends;

a cord lock attached to the other end of said first and second straps, said cord lock slidably engaged with said first and second straps between said ends of said first and second straps to define an adjustable size loop; and, a musical instrument clip attached to said loop, whereby sliding said cord lock relative to said first and second straps alters the size of said loop and length of said first and second straps.

* * * * *